US006861832B2

(12) United States Patent
Perez

(10) Patent No.: US 6,861,832 B2
(45) Date of Patent: Mar. 1, 2005

(54) THRESHOLD VOLTAGE ADJUSTMENT FOR MOS DEVICES

(75) Inventor: Raul A. Perez, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 107 days.

(21) Appl. No.: 10/453,249

(22) Filed: Jun. 2, 2003

(65) Prior Publication Data

US 2004/0239304 A1 Dec. 2, 2004

(51) Int. Cl.[7] ..... G05F 3/16
(52) U.S. Cl. ..... 323/316; 323/280
(58) Field of Search ..... 323/274, 275, 323/280, 281, 314, 315, 316; 327/504, 530

(56) References Cited

U.S. PATENT DOCUMENTS 4,928,056 A * 5/1990 Pease ..... 323/314
6,188,212 B1 * 2/2001 Larson et al. ..... 323/281
6,559,623 B1 * 5/2003 Pardoen ..... 323/274

OTHER PUBLICATIONS

Rincon–Mora, A Low–Voltage, Low Qulescent Current, Low Drop–Out Regulator, IEEE Journal of Solid–State Circuits, Jan. 1998, pp. 36–44, vol. 33, No. 1.

* cited by examiner

*Primary Examiner*—Jessica Han
(74) *Attorney, Agent, or Firm*—William B. Kempler; W. James Brady, III; Frederich J. Telecky, Jr.

(57) ABSTRACT

The Vt of an MOS transistor is lowered in response to its load current. In a LDO (low dropout) regulator, lowering the Vt of the pass transistor with load increases the level of drive that can be applied to the pass transistor thus allowing a smaller transistor to be used for the same load.

18 Claims, 3 Drawing Sheets

300
PMOS
OUTPUT DEVICE
320
VIN_PWR
322
RA
OPAMP
308
304
314
318
326
328
VBE
332
330
305
302
316
324
RB
VREF
338
R2
340
306
310
R1
312
334
CL
RL
IL
336
364
342
346
366
344
1:1
348
350
362
CURRENT LIMIT
354
358
1:X:X
352
360
356

650
652
644
648
600

646
NMOS
OUTPUT DEVICE
640
638
620
628
OPAMP
VIN_PWR
622
RA
604
608
614
618
VBE
605
626
602
616
624
RB
VREF
R2
VREG
606
610
R1
612
642
634
CL
636
RL
IL

400

1.1
1.0
900m
800m
700m
600m
500m
400m
300m
200m
100m
0.0
VOUT
406
404
402
408
1.5
1.7
1.9
2.1
2.3
2.5
VIN_PWR

500

1.1
1.0
900m
800m
700m
600m
500m
400m
300m
200m
100m
0.0
VOUT
508
504
506
502
512
510
1.5
1.7
1.9
2.1
2.3
2.5
VIN_PWR

THRESHOLD VOLTAGE ADJUSTMENT FOR MOS DEVICES

FIELD OF THE INVENTION

The present application relates generally to controlling the threshold voltage (Vt) of a MOSFET device and a particular on controlling of the Vt of a MOSFET device which is the pass transistor in a low dropout (LDO) regulator.

BACKGROUND OF THE INVENTION

A low drop-out (LDO) regulator is a linear regulator which utilizes a transistor or FET to generate a regulated output voltage with very low differential between the input voltage and the output voltage. In battery powered devices, it is common to have a switching regulator such as a buck regulator between the battery and a LDO regulator. This circuit arrangement combines the efficiency of a switching regulator and the fast response of a LDO regulator. In order to maximize the efficiency, it is common to have the output of the switching regulator be very close to the desired regulated voltage. This creates a problem for the drive of the pass transistor of the LDO regulator, typically a PMOS transistor, because the low voltage input will limit the maximum input voltage Vgs that can be applied to the gate of the pass transistor.

FIG. 1 illustrates a known LDO regulator generally shown as 100. A positive output terminal of a reference voltage source 102 is connected to input 104 of operational amplifier 108, the other terminal being coupled to ground via line 106. A second input 105 to the operational amplifier 108 is coupled to ground via resistor 110 and to the output voltage via resistor 112. The output voltage is generated by pass transistor 118 from voltage source (VIN_PWR) 120, which can be the output of the buck regulator, for example (not shown). The back gate of transistor 118 is connected to voltage source 120. The output voltage is generated across output resistor 136 and an output capacitor 138. The equation giving the maximum amount of Vgs that can be applied to the PMOS device 118 is given by equation 1:

$$V_{gs.max}=\text{VIN_PWR}-V_{amp.min} \qquad \text{equation (1)}$$

where $V_{amp.min}$=minimum output voltage of operational amplifier

As seen from equation (1), Vgs will depend on the output voltage swing of the operational amplifier which can further reduce a possible gate drive that can be applied to the MOS output device. For example, if the regulated input voltage on pin 120 is 1.5 V, and the operational amplifier has a minimum output voltage of 0.3 V, a weak transistor having a Vt of one volt, in the worst case, we have a maximum drive of only 0.2 V.

A known solution for this problem is shown in FIG. 2 generally as 200. The circuit of FIG. 2 is similar to the circuit of FIG. 1 and similar components have similar reference numerals. In FIG. 2, the back gate of transistor 218 is not connected directly to the voltage source 220. Instead, it is connected to the input voltage source 220 by Schottky diode 239. The junction of Schottky diode 239 and back gate 218 is coupled via line 240 to NMOS transistor 248, the source of which is coupled to ground via line 250. The gate of transistor 248 is coupled via line 246 to diode connected NMOS transistor 244 which functions as a current mirror to mirror a portion of current flowing through transistor 218 as sampled by NMOS sampling transistor 216. Thus, as the output current increases, the current through the Schottky diode increases which applies a lower voltage to the back gate of transistor 218 which lowers the Vt of the transistor.

One problem with the solution is the need for the Schottky diode which is not available in many semiconductor processes. In some processes the Schottky diodes formed on the integrated circuits have voltage drops that are high enough to forward bias the source-back gate junction. It is critical that the amount of forward bias applied is precisely controlled because too much can mean that the source-back gate junction starts injecting a considerable amount of carriers and the circuit latches up. Too little will not achieve significant lowering of the Vt of the pass transistor. Utilization of discrete components in addition to the integrated circuit is highly undesirable because it increases the size required for the circuit as well as the cost and generally lowers the reliability.

According, there is a need for a circuit that can achieve the objective of lowering the Vt of the pass transistor which can be on an integrated circuit and does not require additional processes in the formation of the integrated circuit.

SUMMARY OF THE INVENTION

It is a general object of the invention to provide a technique for adjusting the threshold voltage Vt of a MOS device.

This and other advantages and features are provided, in accordance with one aspect of the invention by a low dropout voltage (LDO) regulator having a pass transistor coupled between a power source and a load. A p-n diode is coupled between the power source and a reference potential. A resistor divider is coupled in parallel to the p-n diode, an output of the resistor divider being coupled to a back gate of the pass transistor. A variable current source provides a current flow through the parallel combination of the p-n diode and the resistor divider, the variable current flow being proportional to load current.

Another aspect of the invention includes a low dropout (LDO) regulator comprising a differential amplifier having a first input coupled to a voltage reference and a second input coupled to load voltage and generating an error voltage output. A pass transistor is coupled between a power source and the load, the pass transistor having a gate coupled to the error voltage output and being controlled by the error voltage and having a back gate. A p-n diode is coupled between the power source and a reference potential and having a resistor divider coupled in parallel therewith, an output of the resistor divider is coupled to the back gate of the pass transistor. A first current mirror has a sense transistor coupled in parallel to the pass transistor and conducts a current having a predetermined ratio to the load current, and a mirror transistor in series with the p-n diode.

A further aspect of the invention comprises a method of controlling the Vt of the MOS transistor having a back gate. A back gate bias circuit is provided comprising a p-n junction coupled in parallel to a resistor divider, an output of the resistor divider being coupled to the back gate. The back gate bias circuit is in parallel to the source-drain path of the MOS transistor. A current proportional to load current of the MOS transistor is generated and the current is passed through the back gate bias circuit.

DETAILED DESCRIPTION OF THE PRESENT INVENTION

Figure 1:
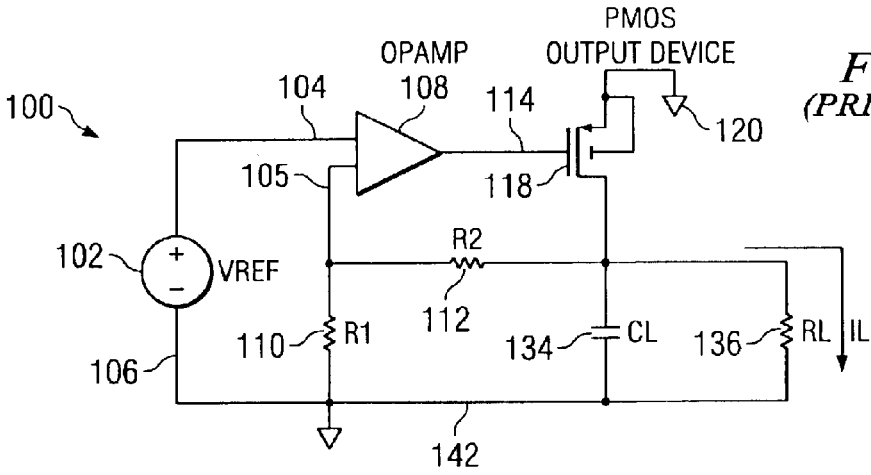
FIG. 1 (PRIOR ART)
FIG. 1 is a circuit diagram of a known LDO regulator circuit.
Figure 2:
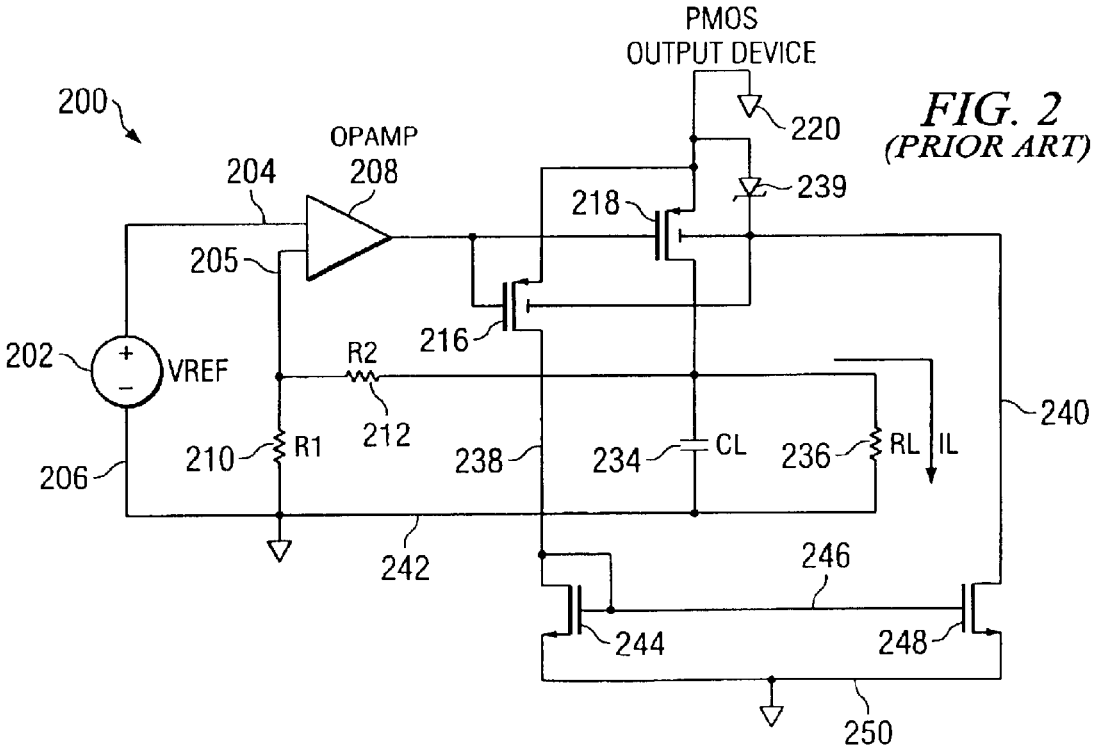
FIG. 2 (PRIOR ART)
FIG. 2 is a circuit diagram of the circuit of FIG. 1 having a known solution.
Figure 3:
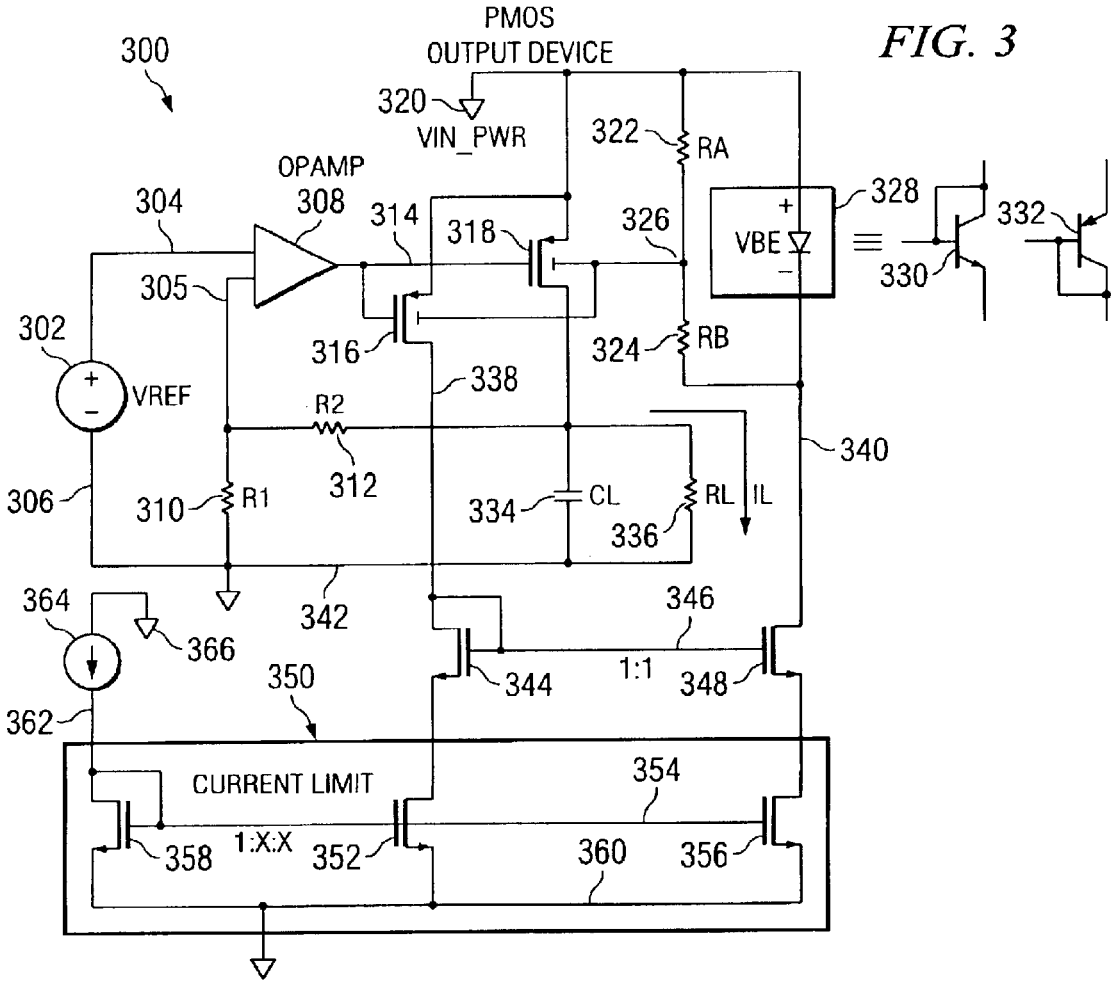
FIG. 3 is a circuit diagram of a LDO regulator utilizing the present invention.

FIG. 3 shows a first embodiment of the present invention generally as 300. The elements having similar reference numerals to FIGS. 1 and 2 have similar reference numbers. A voltage reference 302 has its positive output terminal coupled by lead 304 to one input of operational amplifier 308. The negative output terminal of reference 302 is coupled ground by line 306. Line 305 couples the second input of operation amplifier 308 to resistor 310 with its distal end connected to ground. Resistor 312 is connected to the junction of line 305 and resistor 310 and has its distal end connected to one side of the load resistor 336. The output of operational amplifier 308 on line 314 is coupled to the gates of PMOS transistors 316 and 318. Transistor 318 is a PMOS pass transistor which has its source coupled to an input voltage source 320, which may be the output of a buck regulator, for example. Transistor 316 is a sense transistor which is sized to be much smaller than transistor 318 and which conducts an amount of current proportional to the current flow through transistor 318. A capacitor 334 is coupled across the load resistor 336 between the drain of transistor 318 and ground via line 342. Diode 328 is connected between pin 320 and ground via line 340, transistors 348 and 356 and line 360. The diode 328 can be a diode-connected NPN transistor 330 or PNP transistor 332, for example. A voltage divider comprising resistors 322 and 324 is coupled across the diode 328. The output of the voltage divider at 326 is connected to the back gates of transistors 316 and 318. Line 340 is connected to the drain of NMOS transistor 348. The gate of transistor 348 is connected to the gate of diode-connected NMOS transistor 344 via line 346. The drain of transistor 344 is connected to the drain of transistor 316. Transistors 344 and 348 form a current mirror which mirrors the current sensed by sensing transistor 316 in transistor 348, and thus through diode 328.

The circuit 350 is a current limiting circuit which limits the amount of current in the sensing loop and bias circuit for the diode 328 in order to eliminate excess current when the maximum reduction in Vt has already been achieved. NMOS transistors 352, 356 and 358 form a current mirror. The drain of transistor 356 is connected to the source of transistor 348. The drain of transistor 352 is connected to the source of transistor 344. Transistor 358 is diode connected and has its source connected to ground via line 360. The gates of all 3 transistors are connected together via line 354. A current source 364 is coupled between a power supply input 366 and the drain of transistor 358 via line 362. As shown in FIG. 3, the ratio of the currents between the transistors is 1:X:X, where X can be chosen as any desired ratio. Thus, the current flowing through transistor 358 will be mirrored according to the proportions between X and 1 in transistors 352 and 356. If the current flowing through the transistors 344 and 348 tries to exceed this current, a back voltage will be formed across transistors 352 and 356 which will cause transistors 344 and 348 to conduct less current and thus a current limit function will be performed. The maximum sensing current has to be larger that approximately:

$$I_{CL} \geq \frac{V_{BE}}{R_A + R_B} + I_{diode} \qquad \text{equation (2)}$$

where $I_{diode}$=current through Vbe diode

The back gate forward bias voltage for transistors 316 and 318 is given by the following formula:

$$V_{BG} = \text{VIN_PWR} - V_{SB} = \text{VIN_PWR} - V_{be} \cdot \left(\frac{R_A}{R_A + R_B}\right) \qquad \text{equation (3)}$$

As can be seen from equation 3, the amount of forward bias applied to the source-back gate junction depends on the ratio of resistors Ra and Rb and the Vbe of the NPN transistor. Although the actual value of the resistors can vary from one batch to another of the integrated circuit, the resistors of any individual integrated circuit can be matched within 1%. The exponential I-V curves of the current verses Vbe of the bipolar transistors 330 or 332 ensure that for a wide amount of sense current values the change in the Vbe would be exponentially smaller. This is shown in the equation 4:

$$V_{be} = V_t \cdot \text{Ln}\left(\frac{I_d}{I_S}\right) \qquad \text{equation (4)}$$

where Id=diode current

Is=saturation current

Another advantage of having the current limit circuitry described above is that it will limit the maximum sensing current and therefore lower the variation of which will result in the stabilization of Vbe.

In operation, a buck switching voltage regulator is coupled to the battery of a battery powered device, for example, and generates a voltage of 1.4 V or 1.5V at pin 320, for example (not shown). In this manner, most of voltage drop between the battery power source and the voltage required by the circuit is provided by the high efficiency buck switching voltage regulator. When no current drawn by the load, there is no voltage drop across the diode Vbe and because the back gates of transistors 318 and 326 are connected to the power supply VIN_PWR so that the Vt of transistors 326 is maximized. This minimizes the amount of leakage current at zero load. It is important that the leakage current be limited at zero load to minimize battery drain. It is for this reason that low Vt transistors are not used for the pass transistor. As current is drawn by the load, illustrated as resistor 336, transistor 316 conducts a current proportional to the current flow through transistor 318. The ratio of the currents between transistor 318 and transistor 316 may be 1000:1, for example. The current flowing through transistor 316 is coupled via line 338 through diode connected NMOS transistor 344. The gate of transistor 344 is coupled via line 346 to the gate of transistor 348. The ratio of the sizes of transistors 344 and 348 is 1:1. Therefore, the current flowing through transistor 344 will be replicated in transistor 348. The current flowing into transistor 348 will be drawn via line 340 through the diode 328 to produce an increase in voltage across the diode. This voltage is divided by resistor divider 322, 324 to produce a reduced voltage at divider output 326. If the ratio between resistor 324 and the total resistance 322+324 is less than 0.5, it can be guaranteed that the semiconductor material will not be forward biased to prevent latching up of the device. As the current through transistor 318 seen reaches full load, 200 milliamps for example, the circuit of FIG. 3 reduces the Vt of transistor 318 by approximately 150 to 200 millivolts, effectively doubling the Vgs applied to the transistor.

Current source 364 may supply 1 microamp of current to current limiting circuit 350, for example. This current is coupled via line 362 to diode connected NMOS transistor 358. The gates of transistors 358, 352 and 356 are connected via line 354. If the ratio between the size of transistors 318 and 316 is 1000:1, for example, as described above, then at full load of two hundred milliamperes, 200 microamperes will flow from line 338. This is a waste of power because of the maximum reduction in Vt of transistor 318 takes place with much less than this amount of current through diode 328. The current limiting circuit 350 has a ratio of 1:X:X between transistors 358, 352 and 356. The value X is chosen to represent the maximum current required to pass through diode 328 to produce the maximum reduction in the Vt of transistor 318. This allows the circuit shown in FIG. 3 to have a very low leakage current at essentially zero current and a maximum drop in the Vt at full load.

Figure 4:
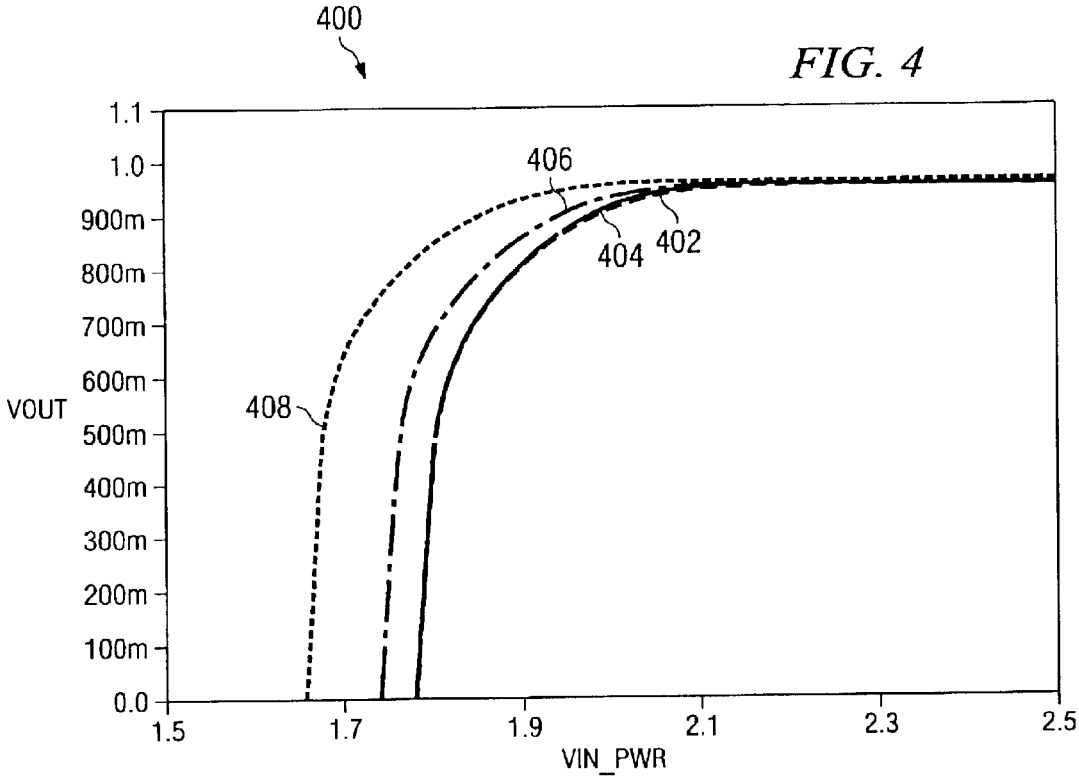
FIG. 4 is a graph of the DC response of the LDO regulators of FIGS. 1 and 3.

Referring now to FIG. 4, the results of a simulation of the present invention and the prior art are shown generally as 400. The curve 402 represents a prior art circuit having a load current of 200 milliamps and a pass transistor having 700 fingers, where each finger is 100 microns long and 0.8 microns wide. The curve 404 represents the present invention utilizing the same pass transistor and the results are so close that the two curves appear one atop the other. However, with the present invention, the load current has been increased to 275 milliamps. This represents an increase of 37.5%. The curve 406 for presents the present invention having the identical pass transistor of curve 404 at a load current of 250 milliamperes. The curve 408 represents the present invention and has the identical pass transistor of curves 406 and 404, at a load current of 200 milliamps. As can be seen from the curves of FIG. 4, the "knee" of the curves moves left showing the present invention can generate an output voltage with reduced input voltage. Thus, as shown in FIG. 4, the input voltage at which current for the regulator dropped to zero decreases from 1.78 volts to 1.66 volts. Thus, the present invention can provide either a greater current with the same characteristics as the prior art or the same current with much improved voltage characteristics with respect to a prior art.

Figure 5:
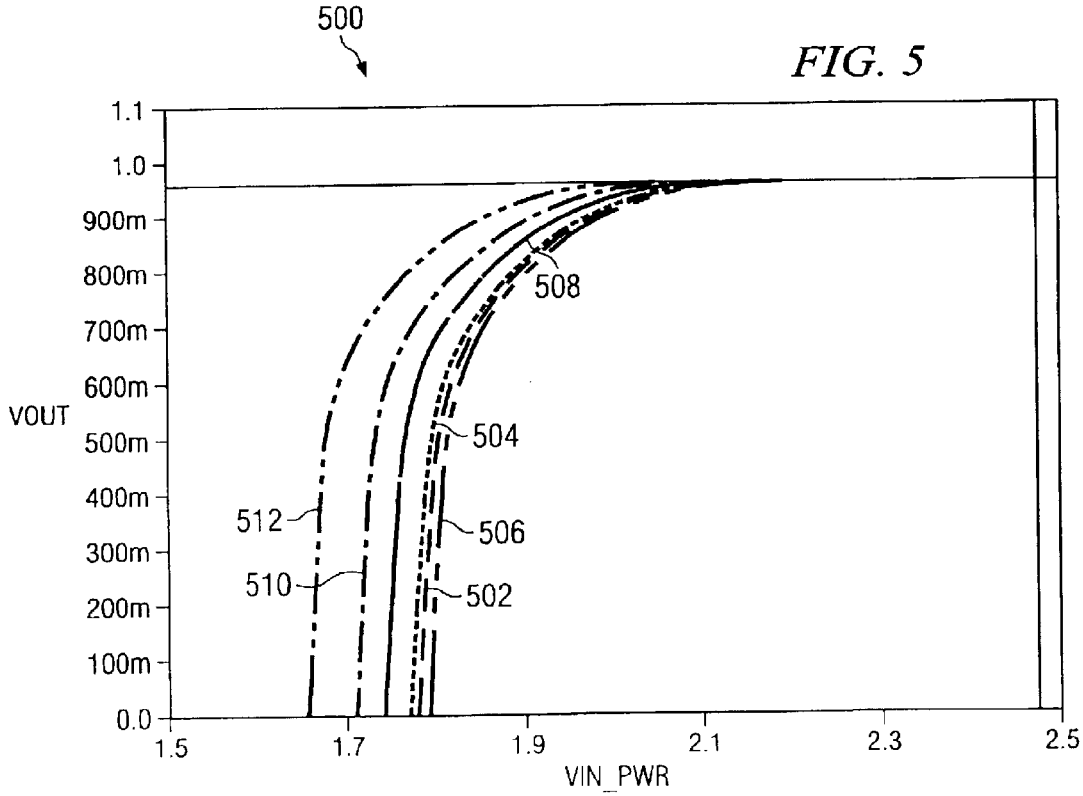
FIG. 5 is a graph of the D.C. response of the regulators of FIGS. 1 and 3 showing the area savings that can be achieved.

FIG. 5 illustrates the drop off characteristics of the present invention and the prior art generally as 500. FIG. 5 is drawn from a different perspective than FIG. 4 in order to show the area savings of the pass transistor of the present invention over the prior art. Curve 502 shows a prior art circuit of FIG. 1 which has a pass transistor having 700 fingers, in which each finger is 100 microns long and 0.8 microns wide. Curve 512 shows the present invention with the same size pass transistor and having the same improvement in the "knee" as shown in FIG. 4. The curve 510 reduces the number of fingers to 600. The curve 508 reduces the number of fingers to 550. Curve 506 reduces the number of fingers to 500 and curve 504 reduces the number of fingers to 510. These two curves bracket the curve 502 which represents the prior art. Therefore, using the present invention to produce the same results as the prior art will need somewhere between 500 and 510 fingers, instead of the 700 fingers required by the prior art. This represents a area savings of 29–27%, respectively.

Figure 6:
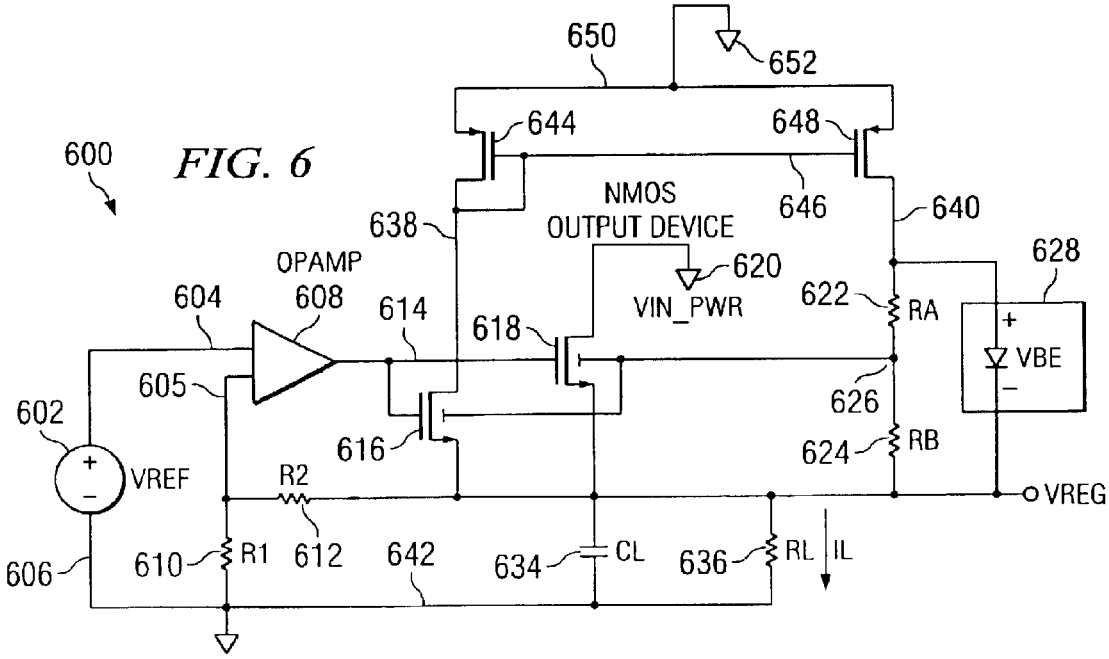
FIG. 6 is a circuit diagram of a LDO regulator utilizing the present invention using a NMOS transistor pass transistor.

As is well known to those skilled in the art, PMOS transistors are generally preferred for making LDO regulators. However, FIG. 6 shows that the principle of the present invention can be applied to NMOS transistors, generally shown as 600 in FIG. 6. The circuit elements in FIG. 6 which correspond to those in FIG. 3 have similar reference numerals. In FIG. 6 a voltage reference 602 has its positive output terminal applied via line 604 to one input of operational amplifier 608. The negative output terminal of the reference voltage is coupled to ground via line 606. The second input to the operational amplifier is coupled via line 605 to the junction of resistors 610 and 612. The distal end of resistor 612 is coupled to ground at line 642. The distal end of resistor 612 is coupled to the load resistor 636 and an output capacitor 634, each of which has their distal ends coupled to ground via line 642. The output of the operational amplifier 608 on line 614 is coupled to the gates of transistors 616 and 618 which are NMOS transistors. The back gates of transistors 616 and 618 are coupled to the junction 626 of resistors 622 and 624. Resistors 622 and 624 are connected in series and coupled in parallel with diode 628. The anode of the diode 628 and the distal end of resistor 622 are coupled via line 640 to the drain of transistor 648. The cathode of the diode and the distal end of resistor 624 are coupled to the regulated output voltage. The drain of transistor 616 is coupled via line 638 to a diode connected NMOS transistor 644. The sources of transistors 644 and 648 are connected together and to a voltage supply 652. The gates of the two transistors are connected together via line 646 to form a current mirror.

Similar to the circuit shown in FIG. 3, a portion of the current passing through transistor 618 passes through sense transistor 616. This current is coupled via line 638 to the current mirror consisting of transistors 644 and 648. The current in line 638 is mirrored in line 640 to forward bias the diode 628. A portion of the voltage across the diode 628 is coupled to the back gates of transistors 616 and 618, and is used to reduce the Vt of these transistors. For simplicity, the current limiting circuit 350 shown in FIG. 3 is omitted from circuit of FIG. 6. However, a current limiting circuit can also be applied it to the this embodiment.

While the invention has been shown and described with reference to preferred embodiments thereof, it is well understood by those skilled in the art that various changes and modifications can be made in the invention without departing from the spirit and scope of the invention as defined by the appended claims.

What is claim is:

1. In a low dropout voltage (LDO) regulator having a pass transistor coupled between a power source and a load, the improvement comprising:

a p-n diode coupled between the power source and a reference potential;

a resistor divider coupled in parallel to the p-n diode, an output of the resistor divider being coupled to a back gate of the pass transistor;

a variable current source providing a current flow through the parallel combination of the p-n diode and the resistor divider, the variable current flow being proportional to load current.

2. The LDO regulator of claim 1 wherein the p-n diode is formed in the bulk semiconductor region.

3. The LDO regulator of claim 1 wherein the p-n diode is a diode-connected NPN transistor.

4. The LDO regulator of claim 1 wherein the p-n diode is a diode-connected PNP transistor.

5. The LDO regulator of claim 1 wherein the pass transistor is a PMOS transistor.

6. The LDO regulator of claim 1 wherein the resistor divider ratio is less that one-half.

7. The LDO regulator of claim 1 wherein the resistor divider is formed of doped polysilicon.

8. The LDO regulator of claim 1 wherein the variable current source is a current mirror which mirrors a predetermined portion of the load current.

9. The LDO regulator of claim 1 further comprising a current limiting stage coupled between the parallel combination of the resistor divider and the p-n junction and the reference potential.

10. The LDO regulator of claim 9 wherein the current limiting stage comprises a current mirror limiting current through a sense transistor and current mirror transistor.

11. A low dropout (LDO) regulator comprising:

a differential amplifier having a first input coupled to a voltage reference and a second input coupled to load voltage and generating an error voltage output;

a pass transistor coupled between a power source and the load, the pass transistor having a gate coupled to the error voltage output and being controlled by the error voltage and having a back gate;

a p-n diode coupled between the power source and a reference potential and having a resistor divider coupled in parallel therewith an output of the resistor divider being coupled to the back gate of the pass transistor; and a first current mirror having a sense transistor coupled in parallel to the pass transistor and conducting a current having a predetermined ratio to the load current, and a mirror transistor in series with the p-n diode.

12. The LDO regulator of claim 11 further comprising a second current mirror coupled between the first current mirror and the reference potential for limiting current flow through the first current mirror.

13. The LDO regulator of claim 11 wherein the pass transistor is a PMOS transistor.

14. The LDO regulator of claim 11 wherein the p-n diode is a diode-connected NPN transistor.

15. The LDO regulator of claim 11 wherein the p-n diode is a diode-connected PNP transistor.

16. A method of controlling the threshold voltage of a MOS transistor having a back gate comprising:

providing a back gate bias circuit comprising a p-n junction coupled in parallel to a resistor divider, an output of the resistor divider being coupled to the back gate, the back gate bias circuit being in parallel to the source-drain path of the MOS transistor; and generating a current proportional to load current of the MOS transistor and passing the current through the back gate bias circuit.

17. The method of claim 16 wherein generating a current proportional to the load comprises mirroring the current in the load using a current mirror.

18. The method of claim 17 wherein a sense transistor having smaller dimensions than the MOS transistor generates the current for the current mirror.

* * * * *